US008747612B2

(12) United States Patent
Heiskanen et al.

(10) Patent No.: US 8,747,612 B2
(45) Date of Patent: Jun. 10, 2014

(54) PROCESS FOR THE PRODUCTION OF MICROFIBRILLATED CELLULOSE IN AN EXTRUDER AND MICROFIBRILLATED CELLULOSE PRODUCED ACCORDING TO THE PROCESS

(75) Inventors: Isto Heiskanen, Imatra (FI); Ali Harlin, Kerava (FI); Kaj Backfolk, Lappeenranta (FI); Risto Laitinen, Imatra (FI)

(73) Assignee: Stora Enso OYJ, Helsinki (FI)

( * ) Notice: Subject to any disclaimer, the term of this patent is extended or adjusted under 35 U.S.C. 154(b) by 0 days.

(21) Appl. No.: 13/503,871

(22) PCT Filed: Oct. 26, 2010

(86) PCT No.: PCT/IB2010/054839

§ 371 (c)(1),
(2), (4) Date: Apr. 25, 2012

(87) PCT Pub. No.: WO2011/051882

PCT Pub. Date: May 5, 2011

(65) Prior Publication Data

US 2012/0214979 A1 Aug. 23, 2012

Related U.S. Application Data

(60) Provisional application No. 61/254,887, filed on Oct. 26, 2009.

(51) Int. Cl.

| | |
|---|---|
| ***D21H 11/20*** | (2006.01) |
| ***D21H 11/18*** | (2006.01) |
| ***D21C 1/08*** | (2006.01) |
| ***D21C 5/00*** | (2006.01) |
| ***C08B 15/08*** | (2006.01) |

(52) U.S. Cl.

USPC ..... 162/18; 162/17; 162/24; 162/25; 162/26; 162/56; 162/78; 536/56

(58) Field of Classification Search

CPC ..... D21H 11/18; D21H 11/20; D21H 11/16; C08B 15/08; D21D 99/00; D21D 1/34; D21C 5/005; D21C 5/00; D21C 1/08; D21C 9/001; D21C 9/002; D21C 9/007

USPC ..... 162/17, 18, 21, 22, 24–26, 56, 76–78; 977/895, 900; 127/37; 536/56

See application file for complete search history.

(56) References Cited

U.S. PATENT DOCUMENTS

| | | | | |
|---|---|---|---|---|
| 4,341,807 | A | 7/1982 | Turbak et al. | |
| 4,427,778 | A * | 1/1984 | Zabriskie | 435/277 |
| 4,483,743 | A * | 11/1984 | Turbak et al. | 162/100 |
| 4,645,541 | A * | 2/1987 | DeLong | 127/37 |
| 4,728,367 | A * | 3/1988 | Huber et al. | 127/1 |
| 5,221,821 | A * | 6/1993 | Burns et al. | 219/121.14 |
| 6,037,380 | A * | 3/2000 | Venables et al. | 514/781 |
| 6,228,213 | B1 * | 5/2001 | Hanna et al. | 162/18 |
| 2005/0274469 | A1 * | 12/2005 | Lundberg et al. | 162/99 |
| 2006/0020126 | A1 * | 1/2006 | Kopesky et al. | 536/30 |
| 2010/0151527 | A1 * | 6/2010 | Endo et al. | 435/72 |

FOREIGN PATENT DOCUMENTS

| | | |
|---|---|---|
| JP | 2008075214 | 4/2008 |
| JP | 2009293167 | 12/2009 |
| WO | 2007/091942 | 8/2007 |
| WO | WO 2008/123419 | * 10/2008 |

OTHER PUBLICATIONS

Lee, S-H. et al. "Enzymatic saccharification of woody biomass micro/nanofibrillated by continuous extrusion process I—Effect of additives with cellulose affinity." Bioresource Technology 2008, Jul. 15, vol. 100, No. 1, pp. 275-279, p. 1, abstract.

Henriksson, M. et al. "Cellulose Nanopaper Structure of High Toughness." Biomacromolecules. May 23, 2008, vol. 9, pp. 1579-1585, p. 1580, "Preparation of MFC."

Saito, T. et al. "Cellulose Nanofibers Prepared by TEMPO-Mediated Oxidation of Native Cellulose." Biomacromolecules. 2007, vol. 8, pp. 2485-2491, abstract.

International Search Report and Written Opinion of the International Searching Authority (PCT/IB2010/054839), Feb. 1, 2011.

* cited by examiner

*Primary Examiner* — Eric Hug

(74) *Attorney, Agent, or Firm* — Greer, Burns & Crain, Ltd.

(57) ABSTRACT

The present invention relates to a process for the production of microfibrillated cellulose wherein the process comprises the steps of, providing a slurry comprising fibers, adding the slurry to an extruder, treating the slurry in the extruder so that the fibers are defibrillated and microfibrillated cellulose is formed. The invention further relates to a microfibrillated cellulose produced.

17 Claims, No Drawings

PROCESS FOR THE PRODUCTION OF MICROFIBRILLATED CELLULOSE IN AN EXTRUDER AND MICROFIBRILLATED CELLULOSE PRODUCED ACCORDING TO THE PROCESS

This application is a U.S. National Phase under 35 U.S.C. §371 of International Application No. PCT/IB2010/054839, filed Oct. 26, 2010, which claims priority to U.S. Provisional Application No. 61/254,887, filed Oct. 26, 2009.

FIELD OF THE INVENTION

The invention relates to process for the production of microfibrillated cellulose by the aid of an extruder.

BACKGROUND

Cellulosic fibers are multi-component structures made from cellulose polymers, i.e. cellulose chains. Lignin, pentosans, hemicelluloses and other components known in art may also be present. The cellulose chains in the fibers are attached to each other to form elementary fibrils. Several elementary fibrils are bound to each other to form microfibrils and several microfibrils form aggregates. The links between the cellulose chains, elementary- and microfibrils are hydrogen bonds.

Microfibrillated cellulose (MFC) (also known as nanocellulose) is a material made from wood cellulose fibers, agricultural raw materials or waste products, where the individual microfibrils have been partly or totally detached from each other. Other raw materials can also be used to produce nano or microfibrils. MFC is normally very thin (~20 nm) and the length is often between 100 nm to 10 μm. However, the microfibrils may also be longer, for example between 10-100 μm but lengths up to 200 μm can also be used. Fibers that has been fibrillated and which have microfibrils on the surface and microfibrils that are separated and located in a water phase of a slurry are included in the definition MFC.

MFC can be produced in a number of different ways. It is possible to mechanically treat cellulosic fibers so that microfibrils are formed. However, it is very energy consuming method to for example shred or refine the fibers and it is therefore not often used without combining the treatment with a pre- or post-treatment.

One example of production of MFC is described in WO2007091942. In the method described in WO20070912942, the MFC is produced by the aid of refining in combination with addition of an enzyme.

However, there is still a need for an improved process for the production of MFC.

SUMMARY OF INVENTION

It is an object of the present invention to provide a process for the production of microfibrillated cellulose in an improved way.

This object, as well as other objects and advantages, is achieved by the process according to claim 1. The invention relates to a process for the production of microfibrillated cellulose wherein the process comprises the steps of, providing a slurry comprising fibers, conducting the slurry to an extruder, treating the slurry in the extruder so that the fibers are defibrillated and microfibrillated cellulose is formed. In this way it has been shown that microfibrillated cellulose can be produced in a very energy efficient way.

At least one modifying chemical is preferably added to the extruder during treatment of the slurry, so that modified microfibrillated cellulose is formed. The use of an extruder for defibrillation of the fibers makes it possible to add a modifying chemical during defibrillation, i.e. at the same time. The design of the extruder thus allows both defibrillation of the fibers and mixing of the fibers with a chemical. Modified or functionalized microfibrillated cellulose can thus be produced in an improved and energy efficient way in a single process step.

The added modifying chemical will preferably modify the surface of the microfibrillated cellulose and/or the modifying chemical will be incorporated into the treated fibers. The fibers being treated in the extruder will soften and/or expand and the addition of a chemical will thus react with the fibers either by modifying the fibers on the surface or by being incorporated into the softened and/or expanded fibers.

The modifying chemical is preferably any of carboxymethyl cellulose (CMC), methyl cellulose, polyvinyl alcohol, calcium stearate, alcohols, different specific and non-specific salts, starch, surfactants, tensides and/or AKD or other hydrophobic chemicals.

The modifying chemical may also be an oxidative chemical, preferably hydrogen peroxide.

The extruder is preferably a conical extruder. The use of a conical extruder is beneficial since the defibrillation of the fibers and mixing with an eventual chemical is very good and efficient.

The solid content of the slurry comprising the fibers being treated in the extruder may be above 30 wt %, preferably above 50 wt %. Due to the flow dynamics in the extruder, above all in a conical extruder, it is possible to increase the dry content of the slurry comprising the fibers to be treated.

The fibers of the slurry may be pre-treated before being conducted to the extruder. It is preferred that the fibers are pre-treated with an enzyme before being conducted and further treated in the extruder.

The invention further relates to microfibrillated cellulose produced according to the process described above.

DETAILED DESCRIPTION OF THE INVENTION

It has been shown that production of MFC may be done in a extruder. It is thus possible to disintegrate the fibers into microfibrillated cellulose of different length in an easy and efficient way.

The extruder can be of any kind, for example a single screw, twin screw or conical extruder. It is preferred to use a conical extruder since it has been shown that the high shear forces in a conical extruder results in the production of microfibrillated cellulose in a very energy efficient way. The conical extruder also makes it possible to control the length of the produced microfibrillated cellulose in a good way.

Conical extruders are traditionally used for application of single or multilayer polymer layers on a co-axial products, profiles and multi-layered films. It can also be used for mixing materials together, such as wood plastics and natural fiber compounds with polymers but not typically targeting actual process of dispersive compounding.

The typical design of the conical extruder is that its rotor (screw) is in the form of a cone. The temperature during the treatment is increased and the optimal temperature depends both on the material used and on the time needed for the fibers to pass the extruder.

Because of unique flow dynamics in the extruder, especially the conical extruder, the dry solid content of the fibers fed into the extruder can be very high, typically above 30 wt % and even preferably above 50 wt %. The produced MFC will thus have increased dry content. This often is beneficial in later usage of the microfibrillated cellulose. If it is necessary to transport the produced MFC it is advantageous to have a high dry content in order to avoid transporting large amounts of water. Also, if the produced MFC is added to surface of for example a paper or board web it is preferred to have high dry content in order to reduce the drying demands of the paper or board.

The fibers are preferably modified. The modification is preferably done by addition of a modifying chemical. Cellulosic fibers can be modified in many different ways in order to alter the properties of the fibers, i.e. to functionalize the fibers. The fibers can for example be carboxylized, oxidized or be made cationic. Surface modification can either be made by a direct surface reaction resulting in a modification or by indirect modification through adsorption of one or several polymers.

In prior art, surface modification techniques such as surface deposition using e.g. corona, flame, atomic layer deposition, plasma treatment or similar treatments are done in a separate process step. The use of a separate modification step increases the production time and the cost for the production of modified fibers. By addition of a modifying chemical to the extruder according to the invention it is possible to modify the fibers at the same time as defibrillation, i.e. in an already existing process step. The modification can thus be done much faster and in a more energy efficient way.

Another advantage by using an extruder when modifying the fibers is that it is possible to modify both the inner and outer regions of the fibers in the extruder at the same time as the fibers are defibrillated and MFC is produced. A normal chemical modification step of microfibrillated cellulose may have the disadvantage of producing varying quality grade fibers partly because of preferred adsorption of chemical to the outer fiber surfaces. By this invention, it is possible to both modify the fibers and produce MFC in a single process step. Especially beneficial is the short residence time under intensive mixing combined with residence time distribution control to avoid unnecessary hornification of the fibers.

The modification is done by addition of the appropriate chemical to the extruder. The fibers which are treated in the extruder are softened and expanded during the treatment and the addition of a chemical will result in a reaction between the fiber and the chemical. The reaction will result in that the fiber is modified, either by modifying the surface of the fibers and/or the chemical may be incorporated into the softened and expanded fiber.

All different kinds of known modifying chemicals may be used, such as carboxymethyl cellulose (CMC), methyl cellulose, polyvinyl alcohol, calcium stearate, alcohols, different specific and non-specific salts, starch, surfactants and/or AKD or other hydrophobic chemicals. Both direct surface modification chemical agents might be used and or process chemical aids such as tensides or alcohol or electrolytes (salts). Some of the chemicals like CMC might also have dual effects such as surface modification and lubrication effect. It is also possible to oxidize the produced fibers by addition of an oxidative chemical, for example by addition of hydrogen peroxide, sodium hypochlorite, calcium hypochlorite, ammonium persulfate. It is also possible to use acids in order to modify the fibers, for example hydrochloric acid or sulphuric acid. The mentioned chemicals may either be added alone or in combination with one or more chemicals.

If starch is used as an additive or if the fibers comprise starch, the starch may be pre-cooked or uncooked. If the fibers comprises starch, either naturally, e.g. potato fibers or by addition the present starch may be cooked during the treatment in the extruder. In these cases it is thus preferred to add uncooked starch.

Similar type of modifications, as to chemical substitution of starch, such as esterfication, etherification, cationization, carboxymethylation etc. can be done in an extruder. Also chemical breaching of cellulose can be done.

If the fibers are cationized it is possible to use the produced modified MFC both as a strength enhancement and as a retention chemical. A cationized MFC might also be of advantage when used in the size press. Here its cationic nature might have positive effect on the interaction with certain inks, such as anionic dye or pigment based inkjet inks.

If the fibers are hydrofobized, for example with akd, modified MFC can be used for hydrofobization of papers and board or composites.

Other additives may also be used. These additives fed to the extruder may have affinity against cellulose and have ability to reduce internal friction of the fibers by means of organizing itself efficiently on cellulose surfaces enabling plasticization and elongations flow of the fibers under shear.

Another big advantage with the present invention is that it is possible to produce a composite in one process step. It is possible to add a waste material and fibers to the extruder and thereafter treat the mixture in the extruder producing a composite comprising of waste material and microfibrillated cellulose. The waste material may be filler, clay, polymer, sawdust and/or recycled fiber based package, such as liquid package waste comprising polymer and/or aluminum.

The fibers which are added to the extruder may be pretreated, for example by refining or addition of chemicals or enzymes.

It is preferred that the fibers are enzymatic pre-treated before being fed to the extruder. It is also possible to add enzymes during the treatment in the extruder. However, the temperature must then be kept low and it is also necessary to increase the time in the extruder so that the enzymes can decompose the fibers in the desired way.

It is also possible to further treat the produced microfibrillated cellulose after the extruder in order to produce an even finer material, such as small nanocellulose. It is much easier and less energy demanding to treat the fibers, for example mechanically, after they have passed the extruder and being both defibrillated and optionally also modified.

The fibers are preferable cellulosic fibers. Both hardwood and/or softwood cellulosic fibers may be treated. Other raw materials such as cotton, agricultural or fibers from cereals can also be used. However, the fibers may also be other type of fibers such as agricultural fibers for example potato fibers.

The microfibrillated cellulose produced according to the process results in more curled microfibrillated cellulose. The fibers, and above all the larger microfibrillated cellulose fibers tend to curl which depending on the end use may be beneficial.

In view of the above detailed description of the present invention, other modifications and variations will become apparent to those skilled in the art. However, it should be apparent that such other modifications and variations may be effected without departing from the spirit and scope of the invention.

The invention claimed is:

1. A process for the production of microfibrillated cellulose, which process comprises the steps of:

providing a slurry comprising fibers, pre-treating the fibers of the slurry, wherein the pre-treatment is an enzymatic treatment or is a refining treatment, adding the pre-treated slurry to an extruder, treating the pre-treated slurry in the extruder so that the fibers are defibrillated and microfibrillated cellulose is formed, adding at least one modifying chemical or an enzyme to the extruder during treatment of the pre-treated slurry, wherein the modifying chemical is an oxidative chemical.

2. The process according to claim 1 wherein the modifying chemical will modify the surface of the microfibrillated cellulose and/or the modifying chemical will be incorporated into the treated fibers.

3. The process according to claim 1 wherein there are at least two modifying chemicals, and wherein the second modifying chemical is any of carboxymethyl cellulose (CMC), methyl cellulose, polyvinyl alcohol, calcium stearate, alcohols, different specific and non-specific salts, starch, surfactants, tensides and/or AKD or other hydrophobic chemicals.

4. The process according to claim 1 wherein the extruder is a conical extruder.

5. The process according to claim 1 wherein the solid content of the slurry comprising the fibers being treated in the extruder is above 30 wt %.

6. The process according to claim 1 wherein the pre-treatment is the enzymatic treatment.

7. Microfibrillated cellulose produced according to the process of claim 1.

8. The process according to claim 1, wherein the oxidative chemical is hydrogen peroxide.

9. The process according to claim 1 wherein the solid content of the slurry comprising the fibers being treated in the extruder is above 50 wt %.

10. The process according to claim 1 wherein the enzyme is added to the extruder.

11. The process according to claim 1 wherein pre-treatment is the refining treatment.

12. A process for the production of microfibrillated cellulose, which process comprises the steps of:

providing a slurry comprising fibers, pre-treating the fibers of the slurry, wherein the pre-treatment is an enzymatic treatment or is a refining treatment, adding the pre-treated slurry to an extruder, adding at least one modifying chemical to the extruder during treatment of the pre-treated slurry, wherein the modifying chemical is an oxidative chemical, treating the slurry in the extruder so that the fibers are defibrillated and modified microfibrillated cellulose is formed.

13. The process according to claim 12 wherein the pre-treatment is the enzymatic treatment.

14. The process according to claim 12 wherein pre-treatment is the refining treatment.

15. A process for the production of microfibrillated cellulose, which process comprises the steps of:

providing a slurry comprising fibers, pre-treating the fibers of the slurry, adding the pre-treated slurry to an extruder, treating the pre-treated slurry in the extruder so that the fibers are defibrillated and microfibrillated cellulose is formed, adding an enzyme to the extruder during treatment of the pre-treated slurry.

16. The process according to claim 15 wherein the pre-treatment is an enzymatic treatment.

17. The process according to claim 15 wherein pre-treatment is a refining treatment.

* * * * *